United States Patent [19]

Lehmann et al.

[11] Patent Number: 4,586,704

[45] Date of Patent: May 6, 1986

[54] BUCKLING-TYPE SHEET FOLDER

[75] Inventors: Werner Lehmann, Gutach; Rainer Fecker, Furtwangen; Wilhelm Markgraf, Tennenbronn, all of Fed. Rep. of Germany

[73] Assignee: Mathias Bäuerle GmbH, Fed. Rep. of Germany

[21] Appl. No.: 719,228

[22] Filed: Apr. 3, 1985

[30] Foreign Application Priority Data

Apr. 4, 1984 [DE] Fed. Rep. of Germany ..... 3412569

[51] Int. Cl.[4] ..... B42C 1/00

[52] U.S. Cl. ..... 270/46; 493/421

[58] Field of Search ..... 270/45, 46, 59; 493/419–421

[56] References Cited

U.S. PATENT DOCUMENTS

| | | | |
|---|---|---|---|
| 2,703,237 | 3/1955 | Rovan et al. | 493/421 |
| 3,178,171 | 4/1965 | Springer et al. | 493/421 |
| 3,416,785 | 12/1968 | Sherman | 270/45 |
| 3,495,818 | 2/1970 | Marin | 493/420 |
| 3,729,186 | 4/1973 | Macke | 493/421 |

FOREIGN PATENT DOCUMENTS

| | | | |
|---|---|---|---|
| 555229 | 4/1958 | Canada | 270/45 |
| 692506 | 6/1953 | United Kingdom | 270/45 |

*Primary Examiner*—E. H. Eickholt

*Attorney, Agent, or Firm*—McGlew and Tuttle

[57] ABSTRACT

A buckling-type paper sheet folder comprises at least two pairs of folding cylinders W1 and W2 and two folding pockets F1, F2. The adjustable sheet stops 65,66, embodied by stop rails, of the folding pockets F1, F2 are secured to endless belts 67,68,69 and 70 which are drivable, conjointly two and two, through a manually actuable shaft 79 or 80. Scales of length S1 to S8 are carried on scale bands 48 and 49 which are associated each with one of the folding pockets F1 or F2 and displaceable by, the respective drive shafts 79, 80 in synchronism with the sheet stops 65, 66. The scale bands 48 and 49 are mounted in the housing to be visible through windows which are provided with reference marks. The sheet stops 65 and 66 can be set to the desired position through the closed housing by means of knobs 81 and 82. To facilitate the setting of the sheet stops, a plurality of scales S1 to S8 is provided on each scale band, each associated with a folding manner and sheet size, and made separately noticeable by a light.

9 Claims, 9 Drawing Figures

Fig. 9
| | | | | |
|---|---|---|---|---|
| P/I | | | 1/2 L | 0 |
| P/A | | | 0 | 1/2 L |
| Z | | | 1/3 L | 1/3 L |
| W | | | 2/3 L | 1/3 L |
| DP | | | 1/2 L | 1/4 L |
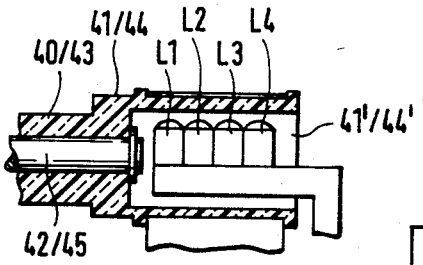
Fig. 7
Fig. 8
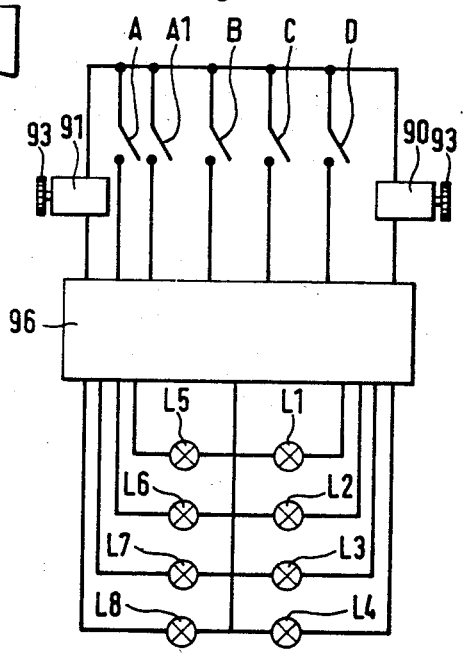

BUCKLING-TYPE SHEET FOLDER

FIELD AND BACKGROUND OF THE INVENTION

This invention relates in general to sheet handling devices and in particular to a new and useful buckling-type folding machine.

In prior art paper sheet folders, the scales of length needed for correctly setting the sheet stops are fixed elements provided in the folding pockets themselves; they are usually embodied by a rule or rail which is provided with a full-size millimeter and/or inch scale, along which the sheet stops are displaceable. For every new sheet length and/or new manner of folding, the sheet stops must be adjusted again. This is complicated and time consuming since such an adjustment, must be made directly on the rail embodying the stop, by a parallel displacement, and particular computation is needed if no proper table is available to read therefrom the scale values to be set. But even with such a table, frequently errors in reading and setting may occur.

A folder is known in which the sheet stops and deflectors can automatically be moved into their positions by means of an electrical control including an operational computer. This is effected by entering through a keyboard or a data carrier and reader the starting size of the sheets, the final size of the folded sheets, and the manner of folding. Such controls, however, are suitable only for large machines employed only in paper treating plants because they are very expensive.

SUMMARY OF THE INVENTION

The present invention is directed to an improvement and simplification of a folder permitting the displacement of the sheet stops by means of simple easy to handle drives, and to determine the desired position of the stop without computation and/or tables, in a simple and error-free way, with only the knowledge of the basic length of the sheets and the desired folding manner.

In accordance with the invention, a buckling-type folding machine comprises at least two folding cylinders arranged adjacent each other and including at least two folding pockets associated with the folding cylinders which have a sheet stop rail thereon with a sheet stop which is movable along the rail and defines sheet deflectors in front of the pocket. Each stop is adjustable independently of each other to set the folded sizes and the folding manner. A draw member is secured to each stop and a drive shaft which advantageously may be manually or power driven drives the draw member. The machine housing has a window with a fixed reference with a band scale movable past the reference which is connected to the drive shat so that movement of the scale to a desired setting will effect a similar setting of the stop.

The main advantage is that the sheet stops can be adjusted from the outside without having to remove or open the housing which may be provided to enclose the folding pockets, for example to suppress the noise. In addition, the scales of length which are needed for adjusting the position of the sheet stops, are provided on scale bands which are movable in synchronism with the sheet stops, relative to fixed reference marks, and which permits use of a plurality of scales for each folding pocket or each stop, properly brought into conformity with various folding manners, they substantially facilitate the selection of the correct location on the respective scale.

Advantageously a plurality of mutually parallel scales of selected lengths and types is provided on each of the scale bands which are employed for the setting of the stop. Zero marks on the scales are in alignment with each other and each scale corresponds to a certain folding manner. Some of the scales are advantageously reduced relative to the natural dimensions in a proportion corresponding to the proportion of the depth to which the sheets to be folded is introduced into either the first or the second pockets to the associated sheets stop, and in proportion to the basic length of the sheet size.

In accordance with another feature of the invention, light sources are associated with the individual scales of the scale bands and they are provided close to a reference mark in or on a housing window of the machine and they can be switched on or off through electrical selector switches associated with each folding procedure. Upon actuating the switch corresponding to the desired folding manner, the operator instantly knows which of the scales are to be adjusted.

The housing windows and the selector switches are provided in a cover of a console type housing in which the scale bands are trained about two rollers mounted at different levels. Such an arrangement is easy to monitor and to operate. The lights are particularly well positioned when the scale band rollers which are mounted close to the housing windows are hollow cylindrical parts which are made of transparent material and the light sources are provided below the individual scales of length which are carried on the bands which are also made of transparent material. The scales are thus illuminated from the inside and can be read more easily.

In order to switch over the feed deflectors or stops provided in front of the respective folding pockets electrical drives in the form of solenoids or servomotors are provided which are controllable from the selector switches. Consequently, when switching on the respective lights the sheet deflectors are positioned at the same time.

Accordingly, it is an object of the invention to provide an improved buckling-type folding machine wherein stops are set automatically by the setting of a scale so that different folding effects and methods may be carried out.

A further object of the invention is to provide an improved buckling-type folding machine in which the folding lengths for each folding stage are selective by the setting of deflector stops which are driven by a drive which is also connected to the setting elements.

A further object of the invention is to provide a folding maching which is simple in design, rugged in construction and economical to manufacture.

BRIEF DESCRIPTION OF THE DRAWINGS

In the drawings:

FIG. 7 is a sectional view of a scale band roller, taken along the line VII—VII of FIG. 2;

FIG. 8 is a block diagram of the electrical control of the light sources associated with the individual scales and the actuators for the paper deflectors; and FIG. 9 is a table of the settable folding procedure choices.

DESCRIPTION OF THE PREFERRED EMBODIMENTS

Figure 1:
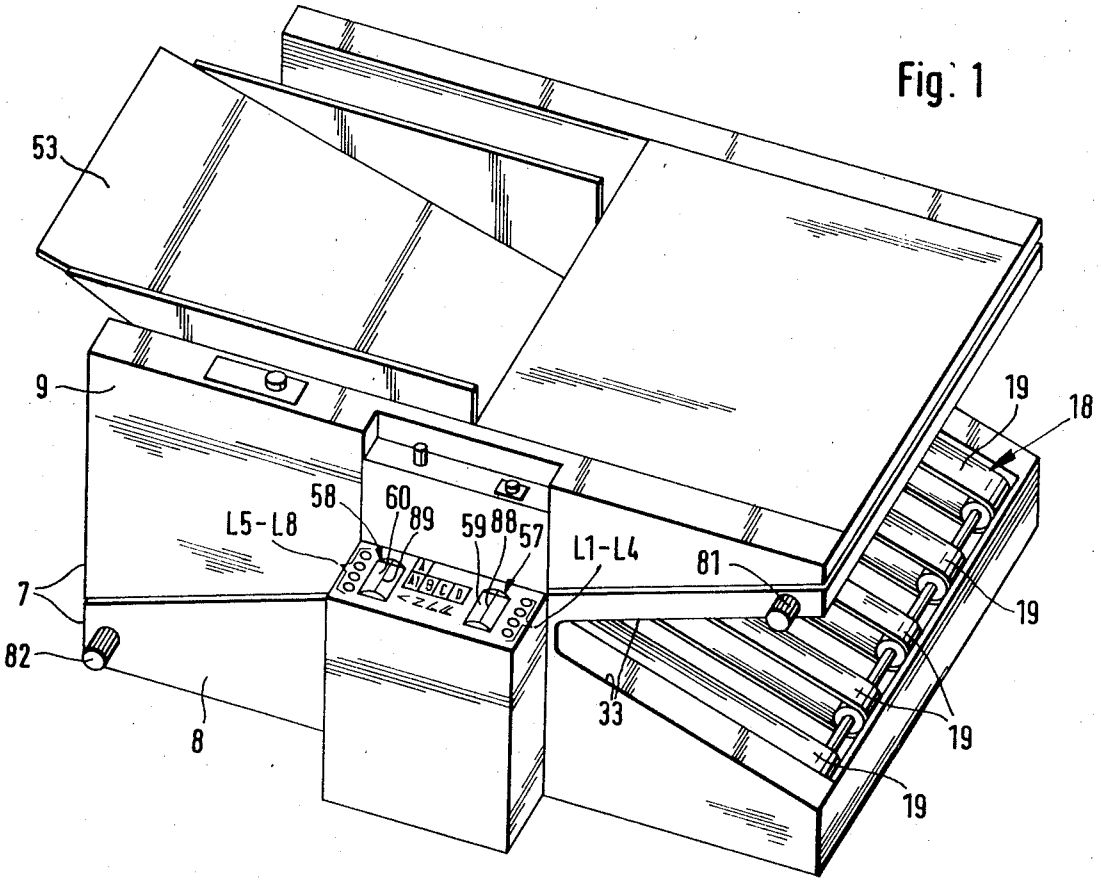
FIG. 1 is a perspective view of a buckling-type folding machine constructed in accordance with the invention.

Referring to the drawings in particular the invention embodied therein comprises a buckling-type folding machine for folding sheets which comprises a housing generally designated 7 which includes inlet feed means in the form of a downward delivery support 53 having associated inlet feed rollers for the inlet of a sheet to be folded. In accordance with the invention, folding means in the housing include a first set of folding cylinders W1 and W2 which define an intake line E therebetween. The folding means also includes a second set of folding cylinders W3 and W4 arranged so that a first folding line I is formed between the rollers W2 and W3 and a second folding line II is formed between folding cylinder W3 and folding cylinder W4. Pocket means are provided in the housing and include a first folding pocket F1 and a second folding pocket F2, which are associated with the folding means for receiving selected lengths of the sheet after it is folded each time so as to position it for a successive folding.

Figure 3:
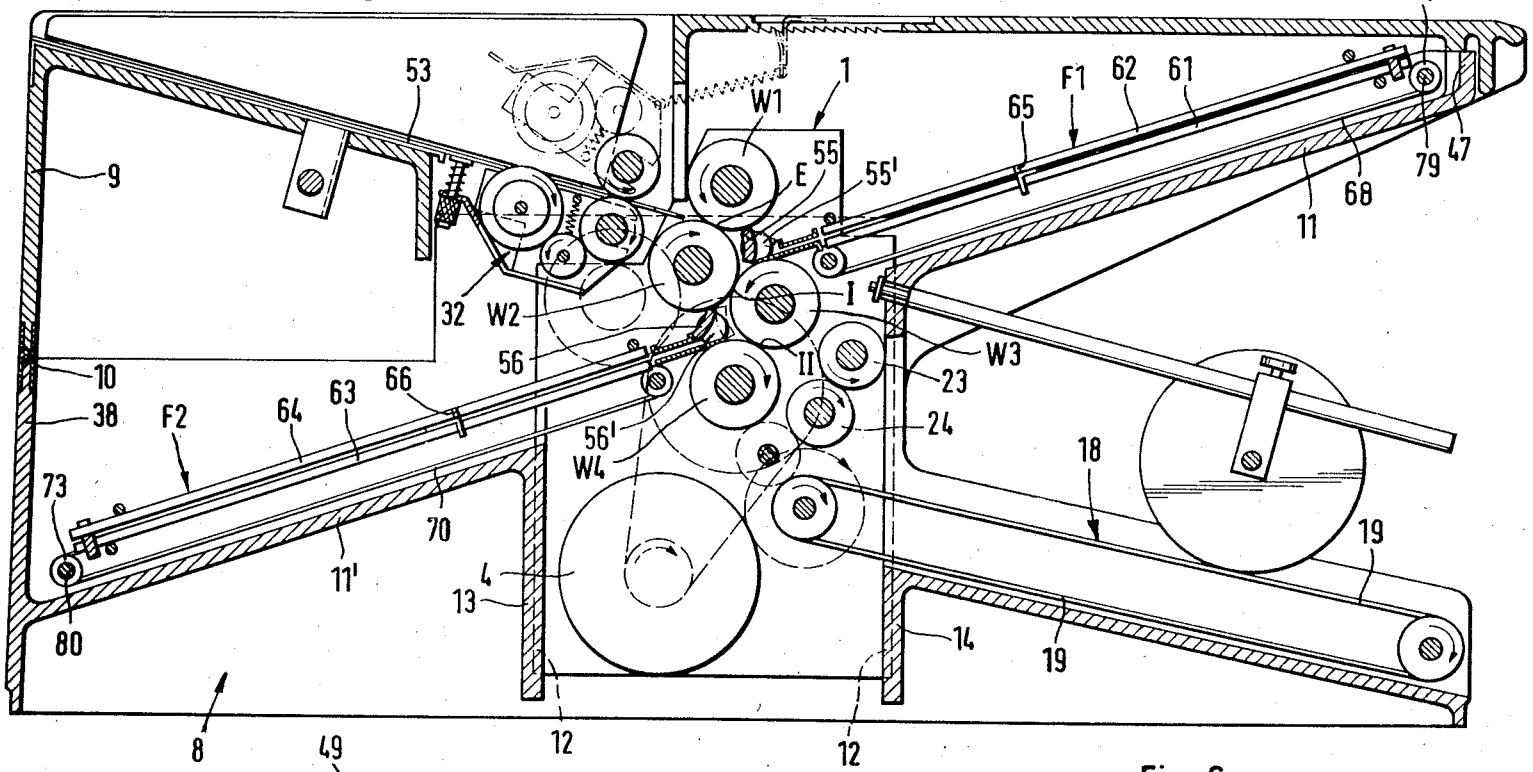
FIG. 3 is a sectional view taken along the line III—III of FIG. 2.

In accordance with a feature of the invention an adjustable sheet stop 65,66 as shown in FIG. 3 is movable in the housing along pocket means and determines the position of the sheet for folding purposes, stop drive means in the form of a draw member 68, 70 are provided for each of the folding pockets F1 and F2.

As shown in FIG. 1, a scale indicator 88 and 89 is provided on the housing and a settable movable scale member 48 or 49 is associated with each pocket means F1 and F2. The drive for the stop is also connected to the drive for the movement of a scale band 48 or 49. This effects the placement of the stop in proportion to the movement of the scale.

Figure 2:
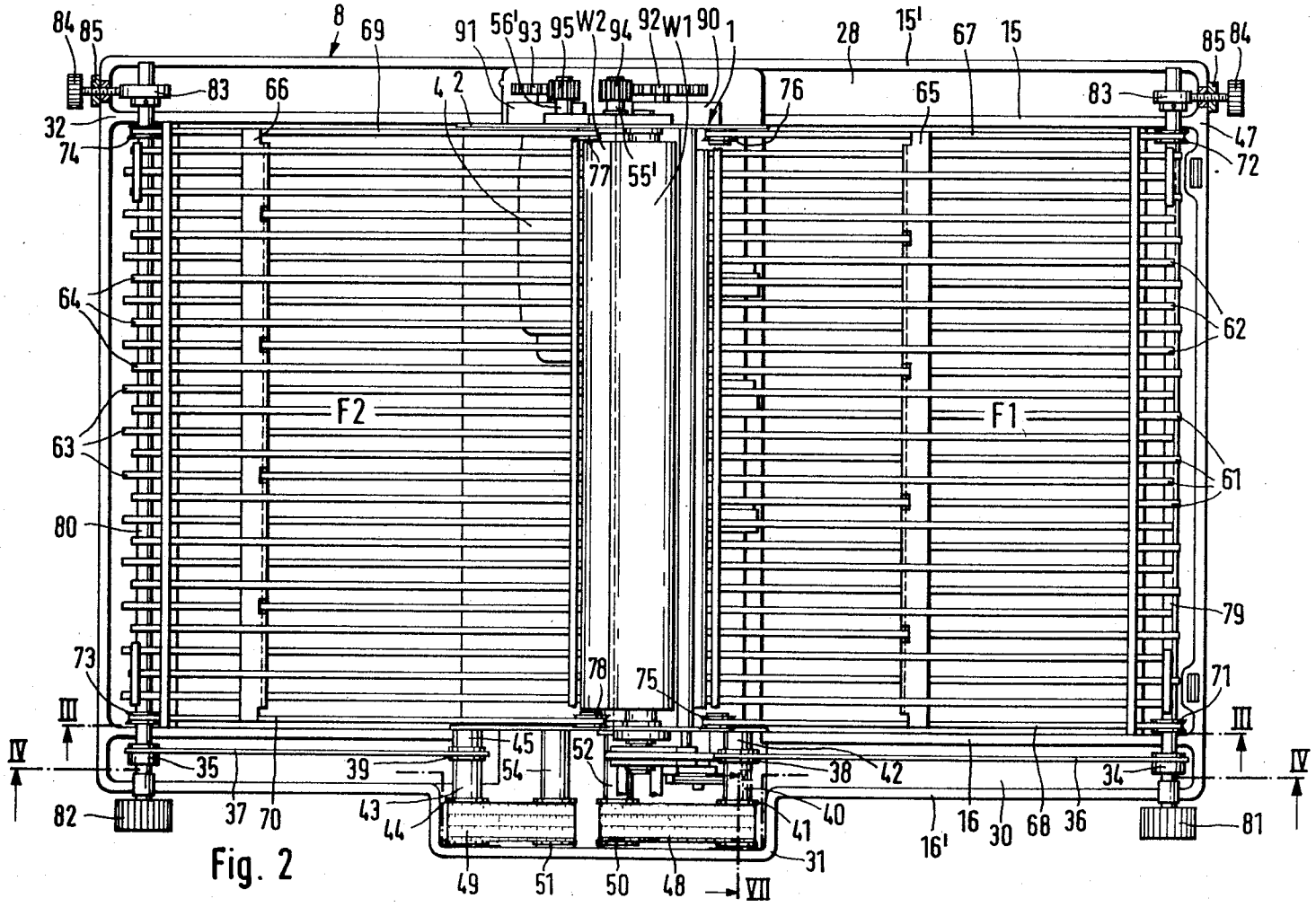
FIG. 2 is a top plan view of an open machine according to FIG. 1, i.e. with the cover removed.

Referring primarily to FIG. 2, the shown folding machine substantially comprises a frame 1 in which a similar mechanism with an electric motor 4 is mounted between two metal plates 2 and 3, and two folding pockets, a first one F1 and a second one F2. The entire assembly is accommodated in a housing 7 having two parts, namely a base 8 and a cover 9, which are connected to each other through a hinge 10. Cover 9 is so designed and hinge 10 is so disposed that with cover 9 swung fully open, the two folding pockets F1 and F2 are freely accessible in the way the machine is shown in FIG. 2. In the middle of base 8, between two bottom plates 11 and 11' which extend directly beneath and parallel to folding pockets F1 and F2, a compartment 12 (FIGS. 3 and 4) is provided for accommodating frame 1, which is bounded by two frontal walls 13 and 14. The two folding pockets F1 and F2 slope at the same angle but at unequal levels, close above bottom plates 11 and 11'. In accordance therewith, two pairs of folding cylinders W1/W2 and W3/W4 are also mounted at different levels and in such position that cylinders W2 and W3 form the first folding line I, and cylinders W3 and W4 form the second and last folding line II, while cylinder W1 which is in contact with cylinder W2 forms therewith an intake line E through which the sheet to be folded is advanced either into folding pocket F1 or directly to folding line I. Downstream of folding line II, a pair of conveying rollers 23 and 24 is provided by which the sheets leaving folding line II are transferred to a conveying mechanism 18 comprising a plurality of conveyor belts 19 and being mounted within base 8 in the space 33 having a triangular configuration.

Further provided is a delivery table 53 which is mounted within cover 9 and extends obliquely downwardly toward intake line E and on which the sheets to be folded can be placed in stacks, to be individually fed to the cylinder mechanism 1 by means of a sheet feeder.

Either of folding pockets F1 and F2 comprises two superposed rod lattices 61 and 62 or 63 and 64 which are spaced from each other by a very small distance and between which a stop rail 65,66, respectively, is inserted serving as a stop for the sheets. Stop rails 65 and 66 are supported by the respective lower rod lattices 61,63 on which they are displaceable in the longitudinal direction thereof. To be ablve to effect this displacement from the outside, with housing 7 closed, stop rails 65,66 are secured by either of their ends to endless draw members or cog belts 67.68 and 69,70 (FIGS. 2 and 3). One cog belt extends at a respective side of each folding pocket F1 and F2. The cog belts are trained about drive wheels 71 and 72 and 73, 74 and tail rollers 75,76 and 77,78. The two sets of drive wheels 71, 72 and 73,74 are secured to respective drive shafts 79 and 80, which are mounted for rotation at the outer ends of folding pockets F1, F2 in base 8, and are provided each with a turning knob 81, 82. As shown in FIGS. 1 and 2, knobs 81 and 82 are provided outside the side wall of base 8, so that they can be actuated while the housing is closed. Drive wheels 71 to 74 and tail rollers 75 to 78 are mounted to ensure that the upper sections of cog belts 67 to 70 extend parallel to the plane of displacement of stop rails 65,66.

To arrest stop rails 65 and 66 in a position once selected, both drive shafts 79 and 80 are provided with a mechanism for fixing the angular position thereof. This mechanism comprises a disc 83 (FIG. 2) non-rotatably secured to shaft 79,80 and set screw with a knurled head 84 which extends through a bushing 85 and a tap hole in wall portion 38, 47 of space 8, and is engageable into disc 83. With set screws 84 loosened, shafts 79,80 are easily rotatable. As an alternative, the rotary knobs may be equipped with arresting mechanisms.

Base 8 of housing 7 comprises two vertical intermediate walls 15,16 which form intermediate spaces 28,30 with outer walls 15', 16'. In intermediate space 30, cog pulleys 34 and 35 are secured to drive shaft 79, 80 which are connected through cog belts 36,37 to other cog pulleys 38,39. Pulley 38 is carried on the hub 40 of a scale band roller 41 which is mounted for rotation on a fixed pin 42 supported on frame 1. Pulley 39 is carried on the hub 43 of a scale band roller 44 which is mounted for rotation on a fixed pin 45 also supported on frame 1. The two scale band rollers 41, 44 are mounted each close beneath the top wall 46 of a console portion 47 of the housing, and are drivable through shaft 79, 80 at the same circumferential speed as drive wheels 71, 72 and 73, 74, so that a synchronous displacement is ensured between cog belt 67,68 or 69,70, and the respective scale band 48, 49.

Figure 4:
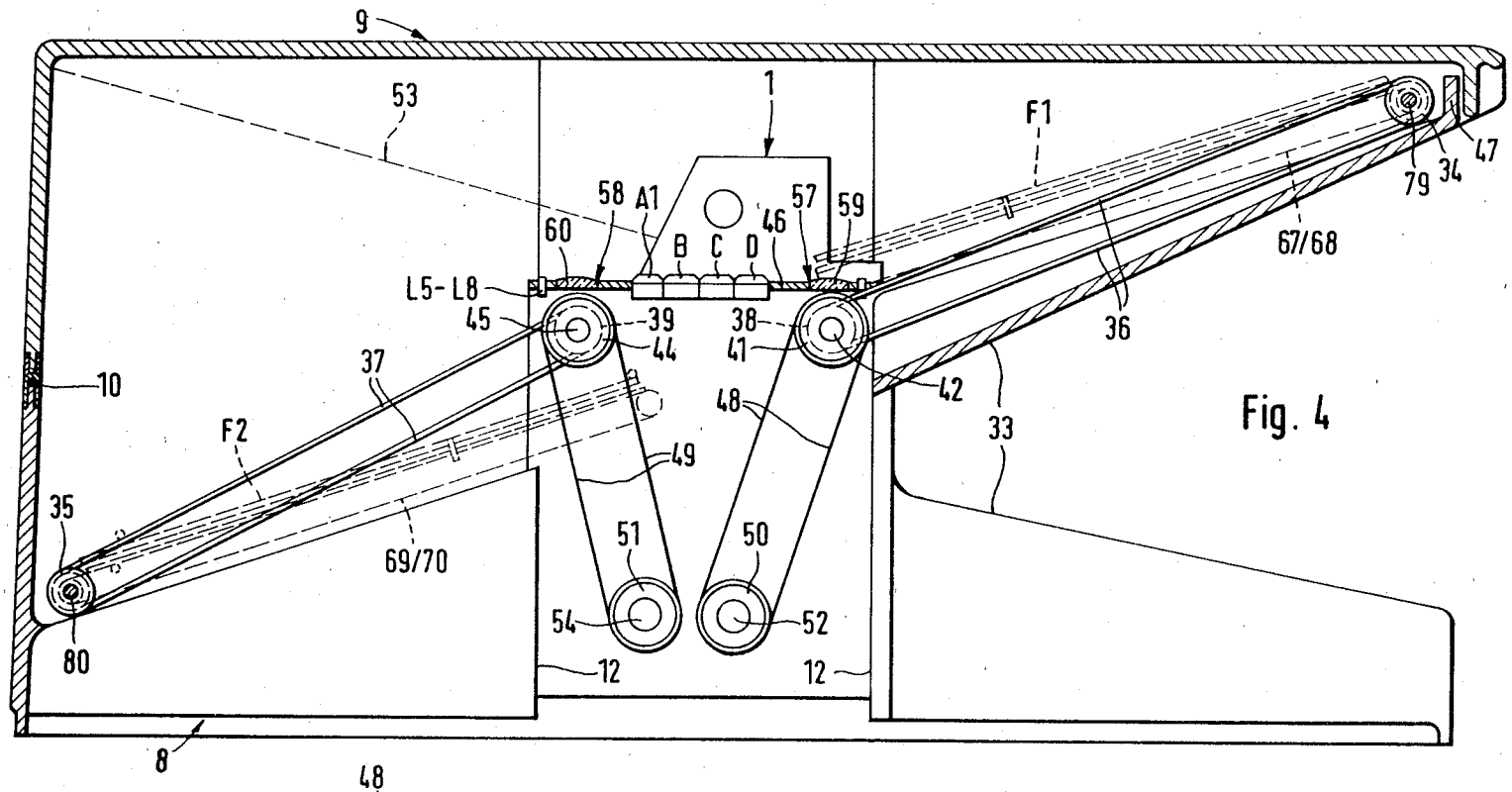
FIG. 4 is a sectional view taken along the line IV-IV of FIG. 2.

Scale bands 48,49 are trained about scale band rollers 41,44 and about tail rollers 50, 51 which are supported on fixed pins 52,54 of frame 1. As shown in FIG. 4, pins 52,54 carrying tail rollers 50, 51 are provided at the bottom of frame 1, so that scale bands 48,49 can be sufficiently long to to carry the necessary graduations.

Figure 5:
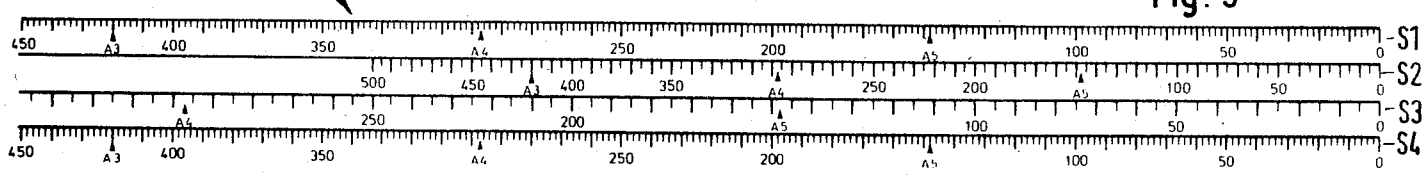
FIG. 5 shows the scales of length provided on a scale band associated with the first folding pocket.

As may be learned from FIG. 2, either of scale bands 48, 49 carry four scales 41–54 of 55–58, which are shown in FIGS. 5 and 5 substantially in full size and will be explained later.

With the aid of these scales 51 to 54 and 55 to 58 on scale bands 48 and 49, and of the sheet deflectors 55, 56 known per se, with which folding pockets F1 and F2 can be closed as needed, altogether five different manners of folding, listed in the table of FIG. 9 can be set, with these manners, indicated in the first column of the table, having the following meaning:

P/I—a simple parallel fold with the upper side inside

P/A—a simple parallel fold with the upper side outside

Z—z folding

W—wrap folding

DP—double parallel fold

To make it easier to the operator to select the correct scale S1 to S8 for a certain manner of folding and thus to correctly set the respective sheet deflector 65, 66, each of scales S1 to S8 is associated with a light source L1 to L8 which may be embodied, as usual in such instances, by light emitting diodes.

Light L1 to L8 may be provided close to the side of housing windows 57, 58 which are provided in top wall 46 covering scale band rollers 41, 44. To facilitate reading, windows 57, 58 may comprise magnifying glasses 59, 60 carrying on their undersides reading marks 88, 89 in the form of hair lines. An arrangement of lights L1 to L8 in groups of four is shown in FIGS. 1 and 4.

Another possibility is indicated in FIG. 7, namely of designing scale band rollers 41, 44 as hollow cylinders of a transparent material and providing the groups of lights L1 to L8 therein, thus below the scales S1 to S8 to illuminate them in this way. In such a case, of course, the scale bands also must be of a transparent or translucent material. To control the lights L1 to L8 to indicate always the combination corresponding to the desired manner of folding, altogether five selector switches A1, B, C, D are provided between windows 57, 58 which can be actuated only separately, which is ensured by proper locking devices (not shown).

By means of these selector switches A1 to D, also two electric servomotors 90,91 (FIGS. 2 and 8) are controllable which are connected, through gears 92,93 meshing with pinions 94,95 to shafts 55', 56' by which the sheet deflectors 45, 56 are carried. As shown in FIG. 8, selector switches A to D and servomotors 90, 91 as well as lights L1 to L8 are interconnected through a logic circuit 96 in a way such that upon actuating a single selector switch A to D, the respective correct lines L1 to L8 light up and the sheet deflectors 55, 56 are brought by motors 90, 91 into the respective operative position.

Figure 6:
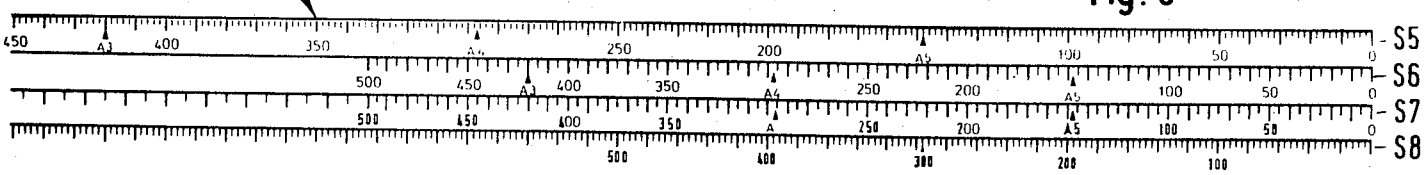
FIG. 6 shows the scales on a band associated with the second folding pocket.

As evident from FIGS. 5 and 6, the graduations of scales S1 to S8 printed on bands 48, 49 are not equal to each other. Scales S1 to S8 are reduced relative to the actual millimeter scale by a factor corresponding to the ratio of the intake depth of the folding pocket F1, F2 associated with the respective scale, to the full length L of the respective sheet size such as A3 to A5, during an operation corresponding to the respective folding manner (see FIG. 9).

Scales S1 to S4 are printed on band 48 which is associated with folding pocket F1, while scales S5, S8 are printed on band 49 which is associated with folding pocket F2.

In accordance with this arrangement, scale S1 which is associated with folding manner P/I and thus with selector switch A, is reduced relative to the actual millimeter scale of one/half, since in this folding manner, the sheet is folded to one/half its full length L, i.e. the sheet penetrates into folding pocket F1 to a depth L/2 and is then folded to one/half at folding line I. This means that the scale mark 100, for example, of scale S1 is spaced from the zero of this scale by 50 mm. During this operation, folding pocket F1, F2 is closed by deflector 56.

Scale S5 is reduced to the same extent since it is associated with folding manner P/A (same single fold, only with the sheet sides reversed, and effected by means of folding pocket F2). The corresponding selector switch is A1 and folding pocket F1 is closed by deflector 55.

Scales S2 and S6 are associated with folding manner Z and selector switch B, and are reduced to one/third relative to the actual millimeter scale since in this manner, the sheet length L in both folding pockets F1 and F2 is reduced to one/third. Consequently, the mark 100 of either of the scales is spaced from the scale zero by 33.33 mm.

Scales S3 and S7 associated with folding manner W (wrap folding) and selector switch C, differ from each other. In this manner of folding, the sheet is first introduced into folding pocket F1 having a depth of $\frac{2}{3}$ L. Then the folded sheet is moved into folding pocket F2 having a depth of $\frac{1}{3}$ L. Consequently, scale S3 is reduced relative to the actual millimeter scale in a ratio 3:2 and scale S7 in a rato 3:1, in other words, the 100 mark is spaced from the zero on scale S3 by 66.67 mm and on scale S7 by 33.33 mm, thus the same distance as on scale S6.

For the folding manner DP (double parallel fold), scales S4 and S8 associated with selector switch D differ from each other. Scale S4 is identical with scale S1 since the first folding is by one half. Scale S8 is reduced to one/fourth of the actual millimeter scale since the folding is again by one/half. Consequently, the mark 100 of scale S8 is spaced from the zero by 25 mm.

The particular advantage of this scale reducing is that the scales S1 and S8 associated with the desired folding manner are in every instance set to the mark indicating the full length L of the respective sheet size, so that the operator is relieved of any computation and has only to know the basic length L of the sheet size. For this reason, the standard sizes A3, A4, A5 are marked in addition. Upon actuating the respective selector switch A to D, a light L1 to L8 indicates to the operator which of the scale bands 48, 49 and of the scales S1 to S8 are to be moved by correspondingly turning shafts 79, 80 to adjust the stop rails 65,66. Since the two sheet deflectors 55, 56 are set through switches A, D and the logic circuit automatically, the operator is relieved also in this regard.

Of course, should economy require omitting of motors 90, 91 and their transmissions, sheet deflectors 55, 56 might be made adjustable manually.

It will be understood that in the present example, lights L1 to L4 are associated with scales S1 to S4, and lights L5 to L8 with scales S5 to S8 respectively.

While specific embodiments of the invention have been shown and described in detail to illustrate the application of the principles of the invention, it will be understood that the invention may be embodied otherwise without departing from such principles.

What is claimed is:

1. A buckling-type folding machine comprising at least two folding cylinders arranged adjacent to each other, at least two folding pockets associated with said folding cylinders, each having a sheet stop rail, a sheet stop movable along said rail and defining a sheet deflector in front of an associated pocket, each stop being adjustable independently of each other to set the folded sizes and folding manner, a draw member secured to each stop, a drive shaft driving said draw member, means defining a fixed reference, a movable scale having at least one scale band associated with each pocket and connected to said drive shaft for movement thereon along with said draw member, said scale being settable in respect to said fixed reference to move said draw member to advance said stop in proportion to the setting of said scale.

2. A buckling-type folding machine according to claim 1, wherein said scale comprises a band having a plurality of parallel scales thereon of selected lengths having zero marks of each scale in alignment, said scales corresponding to respective folding procedures and being reduced relative to an indicated dimensional scale in a proportion corresponding to the proportion of the depth to which a sheet to be folded is introduced into the respective pockets.

3. A buckling-type folding machine according to claim 2, including a separate light source associated with each of said scales arranged adjacent said fixed reference, said housing having a window adjacent said fixed reference which are illuminated by said light sources and switch means associated with said light sources for illuminating lights for respective folding procedures.

4. A buckling-type folding machine according to claim 1, including a housing enclosing said pockets and said folding cylinders including a console portion having a cover with an opening through which respective scale bands are visible, and roller means mounting said scale bands below the opening of said cover.

5. A buckling-type folding machine according to claim 1, wherein said scale includes a plurality of spaced rollers, an endless band engaged with said rollers, a housing enclosing said pockets having a window therethrough through which said band being made of a transparent material and including a light for each band making selective bands visible through the window when the lights are lit.

6. A buckling-type folding machine according to claim 5 including electric drive connected to said drive shaft and a selector switch for each scale selected effective to illuminate the selected band and to move said drive shaft.

7. A buckling-type folding machine for folding sheets, comprising a machine housing, inlet feed means on said housing for the infeed of a sheet to be folded, folding means in said housing engageable with the sheet and effective to fold a plurality of times, pocket means in said housing associated with said folding means for receiving selective lengths of the sheet as it is guided through said folding means so as to position it for folding, an adjustable stop movable in said housing along said pocket means determining the position of said sheet, stop drive means in said housing for said stop, a scale indicator on said housing, a settable scale movable along said indicator and connected to said stop drive means and positioning said stop proportionally to the movement of said scale with reference to said scale indicator.

8. A buckling-type folding machine according to claim 7 wherein said drive means includes a manual drive.

9. A buckling-type folding machine according to claim 7, wherein said drive means includes an endless band carrying said stop and means for driving said endless band, said settable scale comprising a scale band having a plurality of individual scale indications thereon, roller means around which said scale band is guided connected to said drive means.

* * * * *